US006138277A

United States Patent [19]

Gillen et al.

[11] Patent Number: 6,138,277

[45] Date of Patent: Oct. 31, 2000

[54] PROTECTIVE BODY VEST

[76] Inventors: Sherry S. Gillen; James B. Gillen, both of 444 W. Witchwood La., Lake Bluff, Ill. 60044

[21] Appl. No.: 09/447,123

[22] Filed: Nov. 22, 1999

[51] Int. Cl.[7] ..... A41D 13/00

[52] U.S. Cl. ..... 2/102; 2/96; 2/463; 2/464; 2/465; 2/467

[58] Field of Search ..... 2/455, 459, 462–467, 2/2.5, 44, 45, 69, 81, 92–96, 102, 79, 108, 267, 268, DIG. 1

[56] References Cited

U.S. PATENT DOCUMENTS

| | | | |
|---|---|---|---|
| D. 340,542 | 10/1993 | Marlowe . | |
| 614,068 | 11/1898 | Wetzler | 2/102 |
| 931,250 | 8/1909 | Barker | 2/96 |
| 2,743,446 | 5/1956 | Persico et al. | 2/96 |
| 2,756,429 | 7/1956 | Malachowski . | |
| 3,230,545 | 1/1966 | Galley | 2/96 |
| 4,578,821 | 4/1986 | Zufle | 2/2.5 |
| 4,602,385 | 7/1986 | Warren | 2/455 |
| 4,668,202 | 5/1987 | Cheurer . | |
| 4,697,285 | 10/1987 | Sylvester . | |
| 5,127,106 | 7/1992 | Aldridge | 2/81 |
| 5,328,398 | 7/1994 | Aubrey . | |
| 5,465,423 | 11/1995 | Taylor-Varney | 2/92 |
| 5,465,424 | 11/1995 | Cudney et al. . | |
| 5,669,080 | 9/1997 | Culton . | |
| 5,797,143 | 8/1998 | Buxton | 2/102 |
| 5,802,607 | 9/1998 | Triplette | 2/1 |

*Primary Examiner*—John J. Calvert
*Assistant Examiner*—Tejash Patel
*Attorney, Agent, or Firm*—Meroni & Meroni; Charles F. Meroni, Jr.

[57] ABSTRACT

This invention concerns a protective body vest for protecting against impact upon a human torso when worn by an athlete during sporting activities. The invention comprises a multi-section one piece garment comprising of a vest sized and shaped to be worn on the torso of an athlete. The vest comprises of an hour glass simulated shaped shoulder portion with oversized apertures for the arms, a front portion, a pair of side portions and a back tapered design back portion. The front and back portions being sized and shaped in a tapered design. The invention further utilizes an offset opening located off a center axis of the vest to protect vital body parts. The invention further utilize an overlap to protect the body areas below the offset opening.

36 Claims, 3 Drawing Sheets

PROTECTIVE BODY VEST

BACKGROUND OF THE INVENTION

1. Field of the Invention

The present invention relates to protective body vests for protecting against impact upon a human torso when worn by an athlete during sporting activities. More specifically, the present invention is primarily intended to provide a baseball/softball player added protection from being injured by a pitched, thrown, hit or tipped ball or from being injured while being tagged with a ball or from being injured while colliding with an opposing player or sliding into the ground. The present invention can also be utilized by other athletes engaged in other sporting activities, such as, but not limited to, roller blading, skateboarding and touch football to provide added protection from being injured from falling to the ground or colliding with another player.

2. Description of the Prior Art

In recent years, many vests have been created for the purpose of providing protection to the torso of an athlete engaged in sporting activities. These vests, however, only afforded protection to limited areas of the body. In particular, U.S. Pat. No. 5,669,080, issued to Culton, discloses a protective apparatus against baseball pitching injuries, which is essentially a partial vest contoured to protect the chest, shoulders and upper arms of the wearer. Designed primarily for use by baseball/softball umpires, the Protective Apparatus is not conducive to batting, running, throwing, fielding or sliding motions due to the adjustable combination of flexible and non-flexible arm and shoulder straps which secure the vest snugly to the arms, shoulders and neck of the wearer (and prohibit the full and easy movement of the arms and neck of an athlete wearing the apparatus) and the protective covering over the upper arms which the apparatus provides. In addition, the degree of overall protection afforded by the Protective Apparatus from a pitched, hit, thrown or tipped ball, a fall, a collision or from sliding is limited since 1) there is no protection for the sides and back of the torso and 2) the amount of protective material in the apparatus is limited since it is designed to fit under the shirt of an umpire. Designed primarily for use by baseball/softball umpires who would wear the apparatus for an extended period of time (i.e, the duration of the game), the Protective Apparatus is not quickly and easily donned due to the number, location and operation (i.e., any required adjustment for fit) of the securing straps and the fact that the wearer has to put on the vest over his/her head while placing one arm at a time through the arm straps. In particular, to achieve the proper fit of the shoulder strap, the wearer would have to reach around his/her lower back with both hands for the most effective operation of the adjusting mechanism (which is located behind the wearer) unless he/she solicited the help of another person.

Moreover, U.S. Pat. No. 4,668,202, issued to Scheurer et al., and U.S. Pat. No. 5,328,398 issued to Aubrey, both disclose protective vests for flotation utilized in water sporting activities. These vests have a reduced overall flexibility for sporting activities due to the relative rigidity of the vest materials. Further, both of these water vests utilize an exposed center opening for the user to put on the vest, a deep V-neck design and a plurality of adjustable securing belts fastened across the center opening. These water vests are primarily designed for flotation purposes and not for protection against impact from sporting activities. As such, these vests do not provide the necessary protection needed for the whole torso. Though the water vests provide some protection against the impact of the water, the center opening exposes internal organs such as the heart of the athlete to impact. Further, the body area below the center opening is not protected as the center opening is not covered by a protective material. The deep V-neck design further exposes the chest to impact. The back of these water vests do not protect the lower spine, tailbone or ilium areas of the body from impact forces. In particular, U.S. Pat. No. 4,668,202 contains a rear opening to adjust the vest to the particular body size while leaving the back exposed to impact forces.

It therefore becomes highly advantageous to provide a protective vest that can provide the necessary protection from a multi-section one piece garment to the whole torso. It would also be highly advantageous for safety and health concerns to provide a protective body vest with an offset opening to protect against impact from sporting activities to internal organs such as the heart. Further, it would become advantageous for safety reasons to provide a protective body vest with an overlap made of protective material to cover the exposed areas of the torso below the offset opening. Additionally, it would become advantageous to provide a protective body vest with a front tapered design to protect the lower abdomen area. Still, further, it would become advantageous for safety reasons to provide a protective body vest with a back tapered design in the back to protect the lower spine, tailbone and ilium areas of the body. Further yet, it would be highly advantageous to provide a protective body vest that is quickly and easily donned, thus encouraging its use and providing a significant degree of protection to the wearer. In addition, it would become highly advantageous for sporting efficiency to provide a protective vest that can permit unhindered movement of both arms of the athlete wearing the vest. The present invention can provide these and other advantages as is hereinafter explained.

Accordingly, it is a principal object of my invention to provide a multi-section one piece garment having a front and back tapered design with an offset opening and an overlap for safety and health reasons.

It is a further object of my invention to provide a multi-section one piece garment having a front and back tapered design with an offset opening for safety and health reasons.

It is a still further object of my invention to provide a multi-section one piece garment to be sized and shaped for a female athlete.

Other objects of my invention, as well as particular features, elements, and advantages thereof, will be elucidated in, or apparent from, the following description and the accompanying drawing figures.

SUMMARY OF THE INVENTION

According to my present invention we have provided a multi-section one piece garment for protecting against impact upon a human torso when worn by an athlete during sporting activities comprising a vest sized and shaped to be worn on a torso of an athlete having a multi-section padding all around the vest for protectively encasing the torso of the athlete, wherein the multi-section padding material is formed from a polymeric cellular compound punctuated with a plurality of air holes to protect the torso against impact from sporting activities. The vest is comprised of an hour glass simulated shaped shoulder portion, a front portion, a pair of side portions, a back portion, and an offset opening. The multi-section padding has a first section, a second section and a third section wherein the first section is formed from a breathable material for allowing air to permeate the vest, the second section is formed from a padding material for protecting against impact against the torso, the third section is formed from a breathable moisture absorbing material for absorbing moisture generated by the body.

The hour glass simulated shaped shoulder portion has a multi-section padding of a ½ inch to 1 inch to permit unhindered movement of both arms of the athlete wearing the vest. The hour glass simulated shaped shoulder portion further has a limited V-neck design sized and shaped to protect up to a clavicle area and over an athlete's shoulders while permitting full movement of an athlete's neck. The hour glass simulated shaped shoulder portion further has a pair of oversized apertures therein for the arms, each oversized aperture being sized and shaped to permit full movement of both arms leaving the hour glass shaped shoulder portion in an unrestricted condition. Each of the oversized apertures has an edge which is rounded to minimize body chafing.

The front portion of the vest has a the multi-section padding being 1 inch to 1½ inches thick which is sized and shaped in a front tapered design to allow unhindered movement of an athlete's legs and to protect against impact against the lower abdomen area of the body while the athlete is engaged in sporting activities. The front portion further contains the offset opening which is coextensive from the shoulder portion to a bottom of the front portion dividing the front portion into a first side and a second side. The offset opening is located off set from a center axis of the vest to protect against body impact to internal organs such as a heart of the athlete.

The pair of side portions of the vest is located under the pair of oversized apertures wherein each side portion has a multi-section padding being 1 inch to 1½ inches thick which is sized and shaped to protect against impact to the pair of sides while the athlete is engaged in sporting activities.

The back portion of the vest has a multi-section padding being 1 inch to 1½ inches thick to protect against impact against the back while the athlete is engaged in sporting activities. The back portion further is sized and shaped in a back tapered design to allow unhindered movement of an athlete's legs and to provide protection for the lower spine, tailbone and ilium areas of a human body. The back portion further contains a pair of cloth holders for holding a strip of cloth or flag which is removable by an opposing player. The back portion contains a back strap fastener on the back tapered design therein to connect to a front strap fastener located on the front tapered design by a strap, therein to engage the back portion to the front portion to achieve a more secure, more contoured fit of the vest.

The present invention further comprises an overlap which is coextensive from the hour glass simulated shaped shoulder portion to the bottom of the front portion and located over the offset opening for protecting against impact over the offset opening. The overlap has a multi-section padding of a ¼ inch. The overlap is stitched into the first side and fastened across the offset opening by a fastening means located about the offset opening on both the first side and the second side. Further, the overlap further can be temporarily attached to the first side by an overlap fastening means sized and shaped for keeping the overlap clear of the offset opening while the user puts on the vest.

The present invention further comprises a plurality of adjustable securing belts wherein each belt is wrapped around the multi-section padding to secure the vest about the torso of an athlete's body, the plurality of adjustable securing belts are inserted through a plurality of vertical loops, the vertical loops being stitched into the vest at a plurality of locations uniformly spaced about the vest to hold the plurality of adjustable securing belts to engage the torso of the athlete wearing the vest. The plurality of adjustable securing belts are fastened by a plurality of belt fasteners wherein the plurality of belt fasteners are sized and shaped by multi prong fasteners to withstand the impact from sporting activities and are located about the offset opening so as to be covered by the overlap.

According to our present invention, we have provided a multi-section one piece garment for protecting against impact upon a human torso when worn by an athlete during sporting activities comprising a vest sized and shaped to be worn on a torso of an athlete having a multi-section padding all around the vest for protectively encasing the torso of the athlete. The vest further comprises a shoulder portion, a front portion, a pair of side portions, a back portion, and an offset opening.

The offset opening is coextensive from the shoulder portion to a bottom of the front portion dividing the front portion into a first side and a second side, the offset opening being located off set from a center axis of the vest to protect against body impact to internal organs such as the heart of the athlete.

The present invention further comprises of an overlap which is coextensive from the shoulder portion to a bottom of the front portion and located over the offset opening for protecting against impact over the offset opening. The overlap is attached to the vest at the first side and fastened across the offset opening by a fastener means located about the offset opening on both the first side and the second side where the first side has an overlap fastening means sized and shaped for keeping the overlap clear of the offset opening while a user puts on the vest.

The present invention further comprises of a plurality of adjustable securing belts, each belt being wrapped around the multi-section padding to secure the vest about the torso of an athlete's body.

The multi-section padding has at least three sections: a first section being formed from a breathable material for allowing air to permeate the vest, a second section being formed from a padding material for protecting against impact against the torso, a third section being formed from a breathable moisture absorbing material for absorbing moisture generated by the body.

In the shoulder portion, the multi-section padding is sized and shaped to permit unhindered movement of both arms of the athlete wearing the vest. Further, the shoulder portion further has a design sized and shaped to protect up to a clavicle area and over the top of an athlete's shoulders while permitting full movement of an athlete's neck. Further, in the shoulder portion, a pair of oversized apertures are located for the arms, each oversized aperture being sized and shaped to permit full movement of both arms leaving the shoulder portion in an unrestricted condition. Each oversized aperture has an edge which is rounded to minimize body chafing.

The front portion is sized and shaped in a front tapered design to allow unhindered movement of an athlete's legs and to provide protection to the lower abdomen area of the body. In the back portion, the multi-section padding is sized and shaped to protect against impact against the back while the athlete is engaged in sporting activities. The back portion further is sized and shaped in a back tapered design to allow unhindered movement of and athlete's legs and to provide protection to a lower spine, tailbone and ilium areas of a human body. Further in the back portion, at least one cloth holder for holding a strip of cloth is located where the strip is removable by an opposing player. The back tapered design contains a back strap fastener therein to connect to a front strap fastener located on the front tapered design by a strap, therein to engage the back portion to the front portion to achieve a more secured, contoured fit to the vest.

The plurality of adjustable securing belts are attached to the vest by a plurality of attachment means to engage the torso of the athlete wearing the vest where the plurality of adjustable securing belts are fastened by a plurality of belt fasteners. The plurality of belt fasteners are located about the offset opening so as to be covered by the overlap.

In another embodiment, we have provided a multi-section one piece garment for protecting against impact upon a human torso when worn by an athlete during sporting activities comprising a vest sized and shaped to be worn on a torso of an athlete having a multi-section padding all around the vest for protectively encasing the torso of the athlete. The vest further comprising of an hour glass simulated shaped shoulder portion, a front portion, a pair of side portions, a back portion, and an offset opening. The multi-section padding has a first section, a second section, and a third section.

The hour glass simulated shaped shoulder portion has a pair of oversized apertures therein for the arms, each oversized aperture being sized and shaped to permit full movement of both arms leaving the hour glass shaped shoulder portion in an unrestricted condition. Each oversized aperture has an edge which is rounded to minimize body chafing.

The back portion of the vest is sized and shaped in a back tapered design to allow unhindered movement of an athlete's legs and to provide protection to a lower spine, tailbone and ilium areas of a human body.

The offset opening is coextensive from the shoulder portion to a bottom of the front portion dividing the front portion into a first side and a second side where the offset opening is located off set from a center axis of the vest to protect against body impact to internal organs such as a heart of the athlete.

The present invention further comprises of a plurality of adjustable securing belts, each belt being wrapped around the multi-section padding to secure the vest about the torso of the athlete where the plurality of adjustable securing belts are inserted through a plurality of vertical loops. The vertical loops are attached to the vest at a plurality of locations uniformly spaced about the vest to hold the plurality of adjustable securing belts to engage the torso of the athlete wearing the vest. The plurality of adjustable securing belts are fastened by a plurality of belt fasteners which are adjustably located over the front portion.

The first section of the multi-section padding is formed from a breathable material for allowing air to permeate the vest, the second section is formed from a padding material for protecting against impact against the torso, the third section is formed from a breathable moisture absorbing material for absorbing moisture generated by the body.

The hour glass simulated shaped shoulder portion of the vest has the multi-section padding sized and shaped to permit unhindered movement of both arms of the athlete wearing the vest. Further, the hour glass simulated shaped shoulder portion further has a limited V-neck design sized and shaped to protect up to a clavicle area and over an athlete's shoulders while permitting full movement of an athlete's neck.

The front portion and pair of side portions of the vest each has the multi-section padding sized and shaped to protect against impact from sporting activities. The front portion is sized and shaped in a front tapered design to allow unhindered movement of an athlete's legs.

The back portion of the vest has the multi-section padding sized and shaped to protect against impact from sporting activities. The back portion further contains a pair of cloth holders for holding a strip of cloth or a flag which is removable by an opposing player. The back tapered design also contains a back strap fastener therein to connect to a front strap fastener located on the front portion by a strap, therein to engage the back portion to the front portion to achieve a more secured, contoured fit to the vest.

The multi-section padding material is formed from a polymeric cellular compound punctuated by a plurality of air holes to protect the torso against impact from sporting activities The belt fasteners are sized and shaped by multi prong fasteners to withstand the impact from sporting activities and keep the vest secure around the body.

In a further embodiment, we have provided a multi-section one piece garment worn by females for protecting against impact upon the female torso when worn by a female athlete during sporting activities. The multi-section one piece garment comprising a vest sized and shaped to be worn on a torso of a female athlete having a multi-section padding all around the vest for protectively encasing the torso of the female athlete. The vest comprises of an hour glass simulated shaped shoulder portion, a front portion, a pair of side portions, a back portion, and an offset opening. The multi-section padding has a first section, a second section, and a third section.

The hour glass simulated shaped shoulder portion has a pair of oversized apertures therein for the arms, each oversized aperture being sized and shaped to permit full movement of both arms leaving the hour glass shaped shoulder portion in an unrestricted condition. Each oversized aperture has an edge which is rounded to minimize body chafing.

The front portion is sized and shaped in a front tapered design to allow unhindered movement of an athlete's legs. The front portion contains the offset opening which is coextensive from the shoulder portion to a bottom of the front portion dividing the front portion into a first side and a second side. The offset opening is located off set from a center axis of the vest to protect against body impact to internal organs such as a heart of an athlete. The front portion is sized and shaped in a convex configuration, the convex configuration allowing space for each female breast. Further, the pair of side portions is located under the pair of oversized apertures where each side portion has a concave configuration. The concave configuration allows space for each female hip.

The back portion is sized and shaped in a back tapered design to allow unhindered movement of an athlete's legs and to provide protection to a lower spine, tailbone and ilium areas of a human body.

The present invention further comprises of an overlap which is coextensive from the shoulder portion to the bottom portion and located over the offset opening for protecting against impact over the offset opening. The overlap being sized and shaped to incorporate the convex configuration. Further, the overlap is stitched into the vest at the first side and fastened across the offset opening by a fastener means located about the offset opening on both the first side and the second side.

The present invention further comprises of a plurality of adjustable securing belts where each belt is wrapped around the multi-section padding to secure the vest about the torso of the female athlete.

The first section is formed from a breathable material for allowing air to permeate the vest, the second section is formed from a padding material for protecting against impact against the torso, the third section is formed from a breathable moisture absorbing material for absorbing moisture generated by the body.

The hour glass simulated shaped shoulder portion has the multi-section padding sized and shaped to permit unhindered movement of both arms of the female athlete wearing the vest. The hour glass simulated shaped shoulder portion further has a limited V-neck design sized and shaped to protect up to a clavicle area and over an athlete's shoulders while permitting full movement of an athlete's neck.

The front portion and the pair of side portions each has the multi-section padding sized and shaped to protect against impact against the chest and pair of sides while the female athlete is engaged in sporting activities.

The back portion has the multi-section padding sized and shaped to protect against impact the back while the female athlete is engaged in sporting activities. The back portion further contains a pair of cloth holders for holding an strip of cloth or flag which is removable by an opposing player. The back tapered design contains a back strap fastener therein to connect to a front strap fastener located on the front tapered design by a strap, therein to engage the back portion to the front portion to achieve a more secured, contoured fit to the vest.

The plurality of adjustable securing belts are inserted through a plurality of vertical loops where the vertical loops are attached to the vest at a plurality of locations uniformly spaced about the vest to hold the plurality of adjustable securing belts to engage the torso of the female athlete wearing the vest. The plurality of adjustable securing belts are fastened by a plurality of belt fasteners and are located about the offset opening so as to be covered by the overlap.

The multi-section padding is formed from a polymeric cellular compound punctuated with a plurality of air holes to protect the torso against impact from sporting activities.

The first side has an overlap fastening means sized and shaped for keeping the overlap clear of the offset opening while a user puts on the vest.

DESCRIPTION OF THE DRAWINGS

Other features of my invention will become more evident from a consideration of the following detailed description of my patent drawings, as follows.

DETAILED DESCRIPTION OF THE PREFERRED EMBODIMENT

Figure 1:
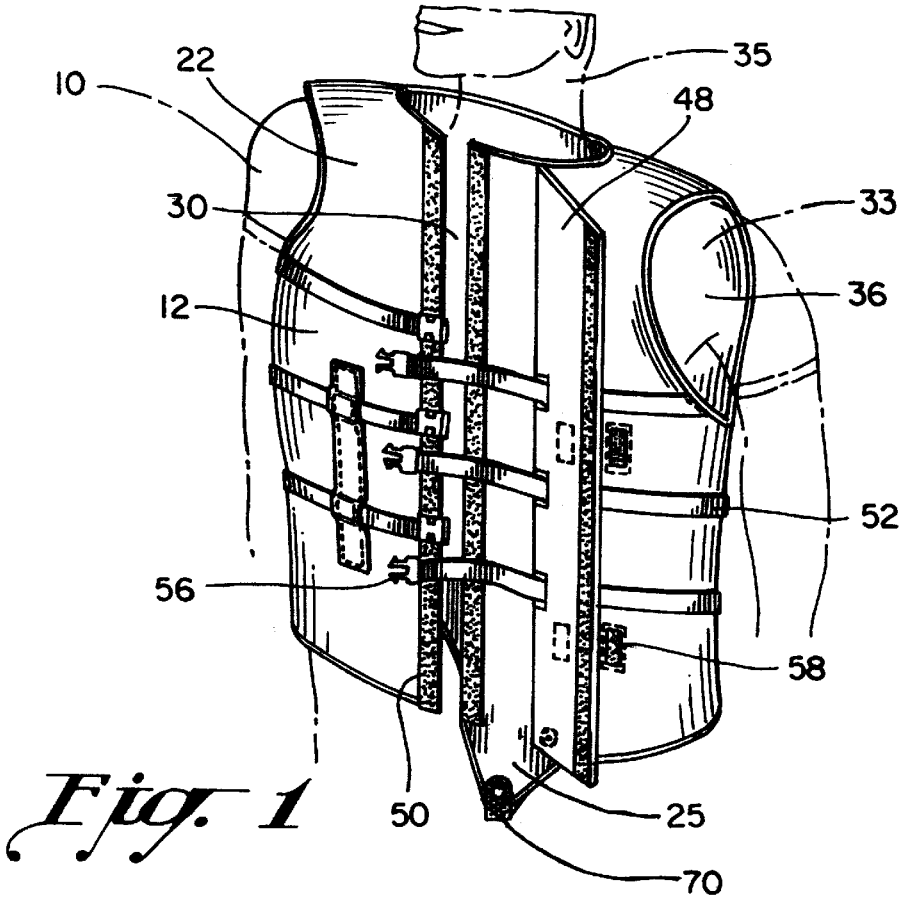
FIG. 1 is a perspective view of the present invention showing the offset opening and the overlap in an open position.
Figure 2:
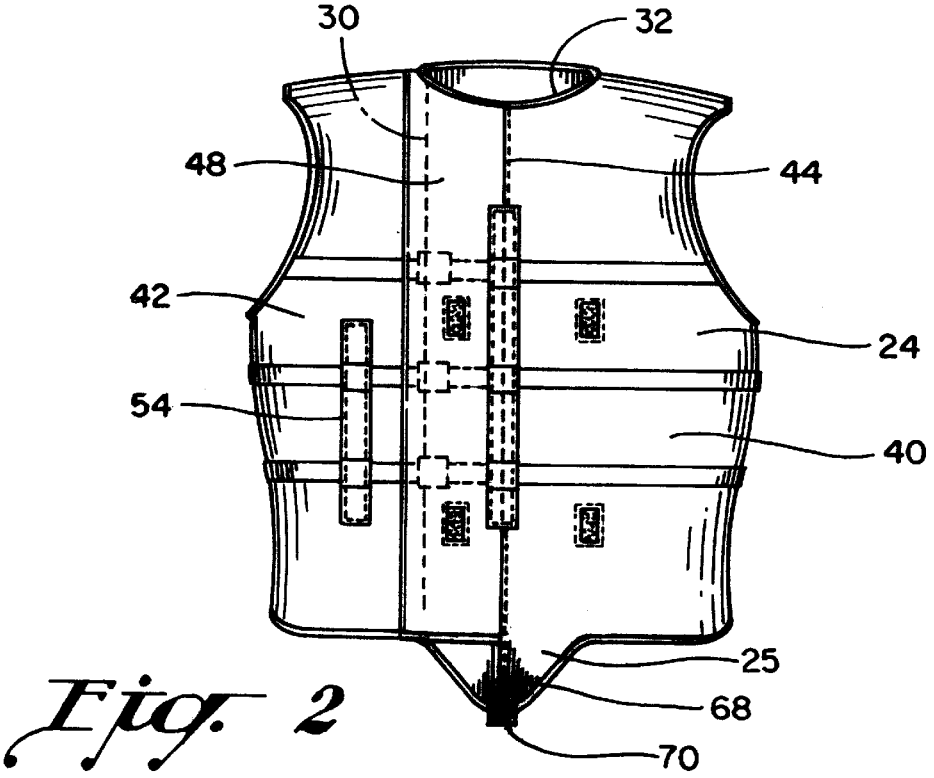
FIG. 2 is a front view of the present invention showing front tapered design and the overlap covering the offset opening in a closed position and further shows the plurality of belt fasteners being located over the offset opening and covered by the overlap.

Referring now to the drawings, our preferred embodiment of the present invention comprises a multi-section one piece garment 10 for protecting against impact upon a human torso when worn by an athlete during sporting activities. Key features of our invention, as shown in FIGS. 1 and 2, are the multi-section one piece garment utilizing an offset opening 30 and an overlap 48 and the front tapered design 25. The multi-section one piece garment 10 comprises of a vest 12 sized and shaped to be worn on a torso by an athlete having a multi-section padding 14, an hour glass simulated shaped shoulder portion 22, a front portion 24, a pair of side portions 26, a back portion 28, and an offset opening 30 as shown in FIGS. 1, 2, 3 and 4.

Figure 6:
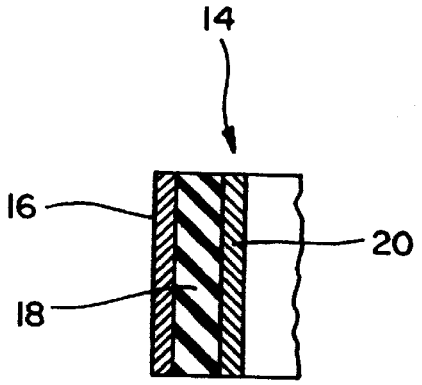
FIG. 6 is a is a cut view of the multi-section padding showing the first section, the second section, and the third section.

As shown in FIG. 6, the multi-section padding 14 contains a first section 16, a second section 18 and a third section 20. The first section 16 is formed from a breathable material for allowing air to permeate the vest 12. The second section 18 is formed from a padding material to sufficiently protect against impact from sporting activities while the third section 20 is formed from a breathable moisture absorbing material for absorbing moisture generated by the athlete. Excellent results are obtained when the multi-section padding 14 is made from polymeric cellular compounds similar in texture, sponginess, flexibility, pliability, resiliency and strength resistance to Polyethylene or Polyvinyl Chloride. Further excellent results are obtained using other polymeric cellular compounds used individually or in a composite including Vinyl Nitrile, Styrene-Butadiene, Neoprene, Ethlylene, Propylene, Terpolymer, Nitrile, Epichlorohydrin, Ethylene Vinyl Acetate and Chlorinated Polyehtlylene.

In order for an athlete, particularly, a baseball/softball player to effectively play, unhindered movement of the arms is needed to throw, hit or catch a ball. Accordingly, as shown in FIGS. 1 and 2, the hour glass simulated shaped shoulder portion 22 has a multi-section padding 14 less than the rest of the vest 12. Excellent sporting efficiency is obtained when the multi-section padding 14 in the hour glass simulated shaped shoulder portion 22 is ½ inch to 1 inch to permit unhindered movement of the torso while providing sufficient impact protection. The hour glass simulated shaped shoulder portion 22 further has a limited V-neck design 32 which is sized and shaped to provide maximum coverage for the athlete up to the clavicle area 34 and over the athlete's shoulders 33 while allowing full movement of the athlete's neck 35.

Figure 4:
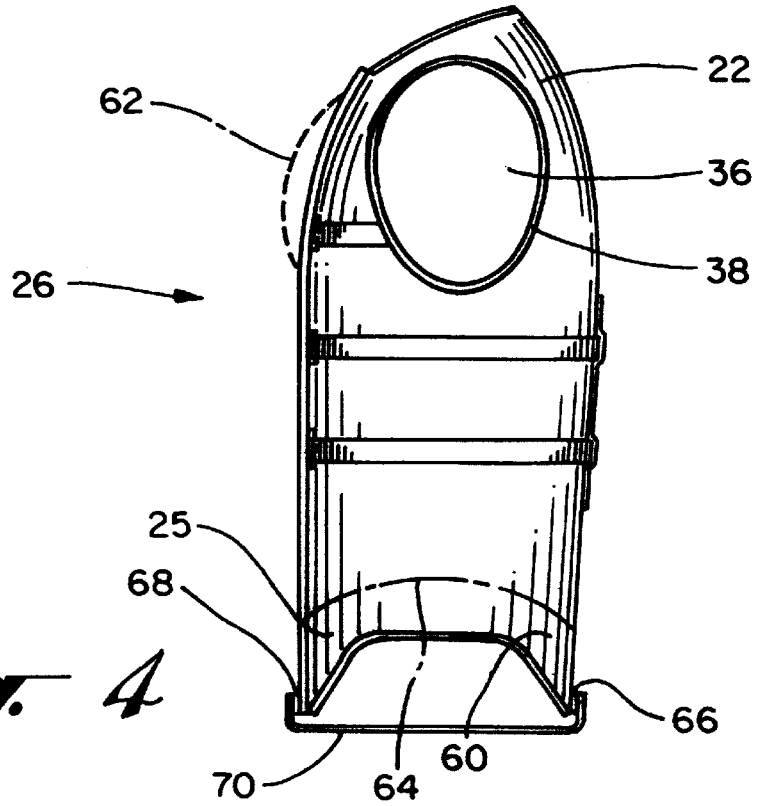
FIG. 4 is a is a side view showing the oversized arm apertures with edging and the convex and concave configurations for the female embodiment and further shows the front and back tapered design connected by the strap.

The hour glass simulated shaped shoulder portion 22 further contains oversized apertures 36 as shown in FIGS. 1 and 4 permitting full movement of the arms of the athlete. These oversized apertures 36 leave the hour glass simulated shaped shoulder portion 22 in an unhindered condition. To improve performance of the athlete, each oversized aperture 36 contains an edge 38 that is rounded to minimize body chafing as shown in FIG. 4.

The front portion 24 has a multi-section padding 14 sized and shaped in a front tapered design 25 to allow unhindered movement of an athlete's legs (not shown) and to provide the necessary protection to the lower abdomen from sporting activities. Excellent results are obtained when the multi-section padding 14 in the front portion 24 is 1 inch to 1½ inches. One of the key features of our invention in the preferred embodiment is an offset opening 30 located in the front portion 24 as shown in FIGS. 1 and 2. Most protective vests contain an opening located in the center of a vest. Better safety and health results are obtained when the vest 12 has an offset opening 30. In the preferred embodiment, the offset opening 30 is located offset from a center axis 44 of the vest 12. By locating the offset opening 30 as shown in FIGS. 1 and 2, internal organs such as a heart (not shown) are not subject to impact forces through the offset opening as in other protective vests. The offset opening 30 extends from the hour glass simulated shaped shoulder portion 22 to the bottom of the front portion 24 dividing the front portion 24 into a first side 40 and a second side 42 as shown in FIG. 2.

The pair of side portions 26 further protects the athlete's torso by having a multi-section padding 14 sized and shaped to provide the necessary protection from impact due to sporting activities as shown in FIG. 4. Excellent results are obtained when the multi-section padding 14 is 1 inch to 1½ inches in the pair of side portions 26.

Figure 3:
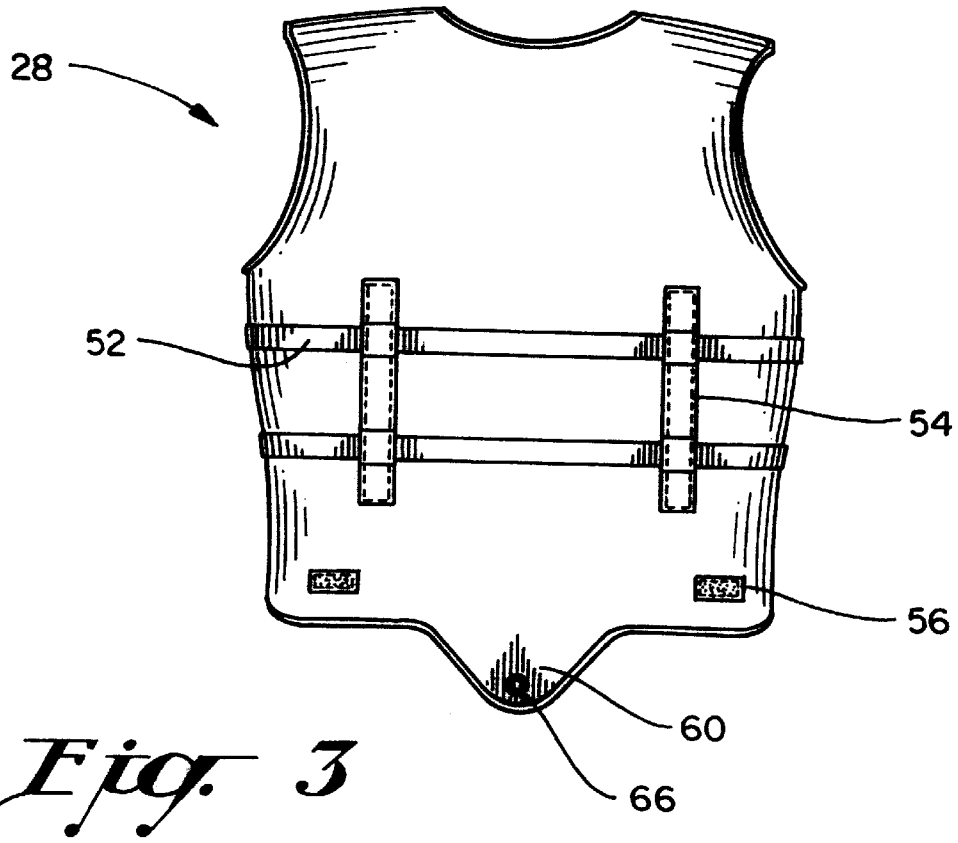
FIG. 3 is a back view of the present invention showing the plurality of adjustable securing belts, the plurality of vertical loops, the back tapered design of the back portion, the cloth holders and the back strap fastener.

The back portion 28 further protects the athlete's torso by having a multi-section padding 14 sized and shaped to provide the necessary protection from impact due to sporting activities as shown in FIG. 3. Excellent results are obtained when the multi-section padding 14 is 1 inch to 1½ inches in the back portion 28. In order to protect the lower spine, tailbone, and ilium areas (not shown) of the human body, the back portion 28 is sized and shaped in a back tapered design 60 as shown in FIG. 3. This back tapered design 60 provides the necessary protection to the lower spine, tailbone and ilium areas (not shown) while allowing optimum running capabilities for the athlete as the athlete's legs (not shown) are unhindered by the back tapered design 60. The back tapered design 60 further contains a back strap fastener 66 which connects to a front strap fastener 68 located on the front tapered design 25 by a strap 70 as shown in FIG. 4. The strap 70 runs between the athlete's legs connects the back portion 28 to the front portion 24 to provide a more secured, contoured fit of the vest 12 around the athlete which is an important consideration for some uses of the vest as in rollerblading. The back portion 28 further contains a pair of cloth holders 46 for holding a strip of cloth or flag (not shown) which can be removed by an opposing player where the game rules allow an opposing player to take a flag off another player as in "flag football." Excellent results are obtained when the pair of cloth holders 46 are comprised of Velcro strips.

Another key feature of our invention is an overlap 48 which extends the entire length of the front portion 24. The overlap 48 is located over the offset opening 30 as shown in FIGS. 1 and 2. The purpose of the overlap 48 is to provide protection of the torso located below the offset opening 30. Without the overlap 48, the area of the torso below the offset opening 30 is exposed to impact from sporting activities. The overlap 48 protects the athlete by having a multi-section padding 14 over the offset opening 30 to provide the necessary protection. Excellent results are obtained when the multi-section padding 14 of the overlap is a ¼ inch in the overlap 48.

As shown in FIGS. 1 and 2, the overlap is attached to the first side 40 and fastened across the offset opening 30 by a fastening means 50 located about the offset opening 30 on both the first side 40 and the second side 42. In the preferred embodiment, the overlap 48 is stitched into the first side 40 and fastened to the second side 42 by the fastening means. Excellent results are obtained when Velcro is utilized as the fastening means 50. Thus, the offset opening 30 is further protected by the multi-section padding 14 incorporated into the overlap 48. In order to facilitate the athlete in pulling on the vest 12, the free end of the overlap 48 can be temporally attached to the first side 40 by an overlap fastening means 58 shown in FIG. 1. Excellent results are obtained when the overlap fastening means 58 comprises of a Velcro strip to temporally hold the overlap 48 away from the offset opening 30 while the athlete puts on the vest 12.

In order to engage the vest 12 around the torso, a plurality of adjustable securing belts 52 is wrapped around the vest 12 as shown in FIGS. 1–3. The adjustable securing belts 52 are held around the vest 12 by being placed through a plurality of vertical loops 54 uniformly spaced and attached about the vest 12. Thus, except for the vertical loops 54, the adjustable securing belts 52 are not otherwise secured to the vest 12 so as not to result in the vest 12 being pulled out of shape. In the preferred embodiment, the vertical loops 56 are stitched into the vest 12, although other means of attaching the vertical loops 56 can be utilized. After the athlete puts on the vest 12, the adjustable securing belts 52 are pulled to a proper fit. The adjustable securing belts 52 are fastened by a plurality of belt fasteners 56 as shown in FIGS. 1 and 2. In the preferred embodiment, the belt fasteners 56 are sized and shaped by multi prong adapters. The adjustable securing belts 52 are fastened by the belt fasteners 56 about the offset opening 30 in order for the belt fasteners 56 to be covered by the overlap 48 as shown in FIG. 2. Thus, the belt fasteners 56 are sized and shaped to fasten under the overlap 48 providing further protection as the overlap 48 will cover and prohibit the belt fasteners 56 from catching the ground in a planned sliding motion or from being grabbed by an opposing player.

Figure 5:
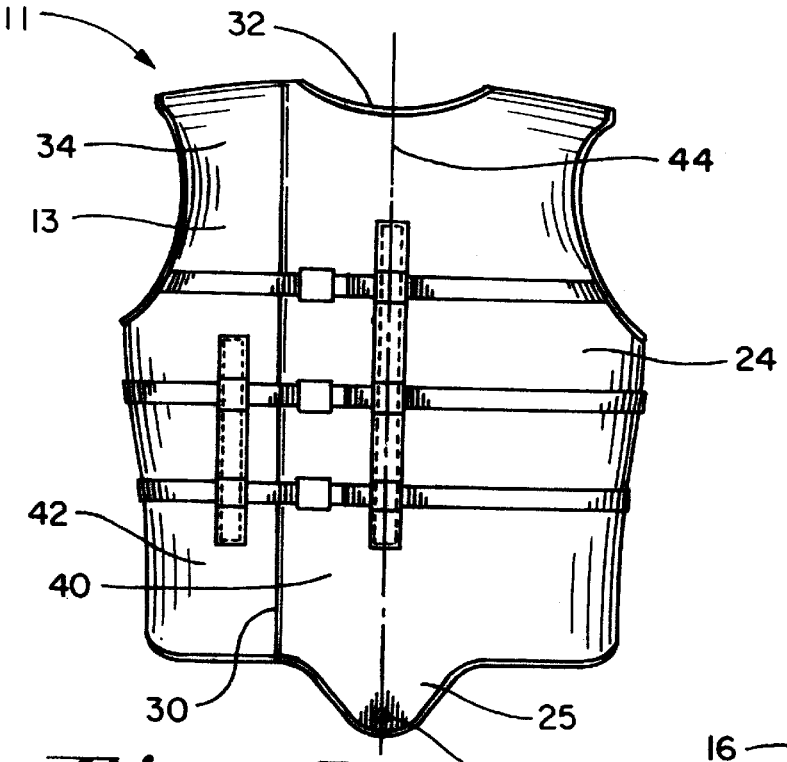
FIG. 5 is a is a front view of the alternative embodiment with the offset opening without the overlap and the plurality of belt fasteners being located on the front portion away from the offset opening.

Another embodiment of the present invention comprises a multi-section one piece garment 10 for protecting against impact upon a human torso when worn by an athlete during sporting activities. One of the key features of our invention, as shown in FIG. 5 is that the multi-section one piece garment utilizes an offset opening 30. The multi-section one piece garment 11 comprises of a vest 13 sized and shaped to be worn on a torso by an athlete having a multi-section padding 14, an hour glass simulated shaped shoulder portion 22, a front portion 24, a pair of side portions 26, a back portion 28, and an offset opening 30 as shown in FIGS. 3, 4, and 5.

As shown in FIG. 6, the multi-section padding 14 contains a first section 16, a second section 18 and a third section 20. The first section 16 is formed from a breathable material for allowing air to permeate the vest 13. The second section 18 is formed from a padding material to sufficiently protect against impact from sporting activities while the third section 20 is formed from a breathable moisture absorbing material for absorbing moisture generated by the athlete. Excellent results are obtained when the multi-section padding 14 is made from polymeric cellular compounds with a plurality of air holes similar in texture, sponginess, flexibility, pliability, resiliency and strength resistance to Polyethylene or Polyvinyl Chloride.

In order for an athlete, particularly a baseball/softball player, to effectively play, unhindered movement of the arms is needed to throw, hit or catch a ball. Accordingly, as shown in FIGS. 1 and 2, the hour glass simulated shaped shoulder portion 22 has a multi-section padding 14 less than the rest of the vest 12. The hour glass simulated shaped shoulder portion 22 further has a limited V-neck design 32 which is sized and shaped to provide maximum coverage for the athlete up to the clavicle area 34 and over the athlete's shoulders (not shown) while allowing full movement of the athlete's neck (not shown).

The hour glass simulated shaped shoulder portion 22 further contains oversized apertures 36 as shown in FIGS. 1 and 4 permitting full movement of the arms of the athlete. These oversized apertures 36 leave the hour glass simulated shaped shoulder portion 22 in an unhindered condition. To improve performance of the athlete, each oversized aperture 36 contains an edge 38 that is rounded to minimize body chafing as shown in FIG. 4.

The front portion 24 has a multi-section padding 14 sized and shaped in a front tapered design 25 to provide the necessary protection from sporting activities to the lower abdomen area. One of the key features of our invention in preferred embodiment is an offset opening 30 located in the front portion 24 as shown in FIG. 5. Better safety and health results are obtained when the vest 13 has an offset opening 30. In the preferred embodiment, the offset opening 30 is located offset from a center axis 44 of the vest 13. By locating the offset opening 30 as shown in FIG. 5 internal organs such as a heart (not shown) are not subject to impact forces through the offset opening as in other protective vests. The offset opening 30 extends from the hour glass simulated shaped shoulder portion 22 to the bottom of the front portion 24 dividing the front portion 24 into a first side 40 and a second side 42 as shown in FIG. 2.

The pair of side portions 26 further protects the athlete's torso by having a multi-section padding 14 sized and shaped to provide the necessary protection from impact due to sporting activities as shown in FIG. 4.

The back portion 28 further protects the athlete's torso by having a multi-section padding 14 sized and shaped to provide the necessary protection from impact due to sporting activities as shown in FIG. 3. In order to protect the lower spine, tailbone, and ilium areas (not shown) of the human body, the back portion 28 is sized and shaped in a back tapered design 60 as shown in FIG. 3. This back tapered design 60 provides the necessary protection to the lower spine, tailbone and ilium areas (not shown) while allowing optimum running capabilities for the athlete as the athlete's legs (not shown) are unhindered by the back tapered design 60. The back tapered design 60 further contains a back strap fastener 66 which connects to a front strap fastener 68 located on the front tapered design 25 by an strap 70 as shown in FIG. 4. The strap 70 runs between the athlete's legs connects the back portion 28 to the front portion 24 to provide a tight fit of the vest 12 around the athlete. The back portion 28 further contains a pair of cloth holders 46 for holding a strip of cloth or flag (not shown) which can be removed by an opposing player where the game rules allow an opposing player to take a flag off another player as in "flag football." Excellent results are obtained when the pair of cloth holders 46 are comprised of Velcro strips.

In order to engage the vest 13 around the torso, a plurality of adjustable securing belts 52 is wrapped around the vest 13 as shown in FIGS. 1–3. The adjustable securing belts 52 are held around the vest 13 by being placed through a plurality of vertical loops 54 uniformly spaced and attached about the vest 13. Thus, except for the vertical loops 54, the adjustable securing belts 52 are not otherwise secured to the vest 12 so as not to result in the vest 13 being pulled out of shape. In the alternative embodiment, the vertical loops 56 are attached to the vest 13. After the athlete puts on the vest 13, the adjustable securing belts 52 are pulled to a proper fit. The adjustable securing belts 52 are fastened by a plurality of belt fasteners 56 which are sized and shaped by multi prong adapters as shown in FIG. 3.

In another embodiment, the present invention is comprised of a multi-section one piece garment 10 of the preferred embodiment utilized for protecting against impact upon a female torso when worn by a female athlete during sporting activities.

In this alternative embodiment, the front portion 24 is sized and shaped in a convex configuration 62 as shown in the dotted section of FIG. 4. This convex configuration 62 allows space for each female breast (not shown). Additionally, the pair of side portion 26 are located under the pair of oversized apertures 36. Each side portion 26 has a concave configuration 64 as shown in the dotted section of FIG. 4. The concave configuration 64 allows space for each female hip.

As various possible embodiments may be made in the above invention for use for different purposes and as various changes might be made in the embodiments and methods above set forth, it is understood that all of the above matters here set forth or shown in the accompanying drawings are to be interpreted as illustrative and not in a limiting sense.

What is claimed is:

1. A multi-section one piece garment for protecting against impact upon a human torso when worn by an athlete during sporting activities comprising:

a vest sized and shaped to be worn on a torso of an athlete, the vest having a multi-section padding all around the vest for protectively encasing the torso of the athlete including a chest, a stomach, a lower abdomen, a pair of sides and a back, an hour glass simulated shaped shoulder portion, a front portion, a pair of side portions, a back portion, and an offset opening, the multi-section padding having a first section, a second section and a third section, the first section being formed from a breathable material for allowing air to permeate the vest, the second section being formed from a padding material for protecting against impact against the torso, the third section being formed from a breathable moisture absorbing material for absorbing moisture generated by the body, the hour glass simulated shaped shoulder portion having the multi-section padding being ½ inch to 1 inch to permit unhindered movement of both arms of the athlete wearing the vest, the hour glass simulated shaped shoulder portion further having a limited V-neck design sized and shaped to protect up to a clavicle area and over an athlete's shoulders while permitting full movement of an athlete's neck, the hour glass simulated shaped shoulder portion further having a pair of oversized apertures therein for the arms, each oversized aperture being sized and shaped to permit full movement of both arms leaving the hour glass shaped shoulder portion in an unrestricted condition, each oversized aperture having an edge, the edge being rounded to minimize body chafing, the front portion having the multi-section padding being 1 inch to 1½ inches sized and shaped in a front tapered design to allow unhindered movement of an athlete's leg and to protect against impact against the chest, stomach and lower abdomen while the athlete is engaged in sporting activities, the front portion further containing the offset opening, the offset opening being coextensive from the shoulder portion to a bottom of the front portion dividing the front portion into a first side and a second side, the offset opening being located off set from a center axis of the vest to protect against body impact to internal organs such as a heart of the athlete, the pair of side portions being located under the pair of oversized apertures, each side portion having the multi-section padding being 1 inch to 1½ inches sized and shaped to protect against impact to the pair of sides while the athlete is engaged in sporting activities, the back portion having the multi-section padding being 1 inch to 1½ inches to protect against impact against the back while the athlete is engaged in sporting activities, the back portion further being sized and shaped in a back tapered design to allow unhindered movement of the athlete's legs and to provide protection for the lower spine, tailbone and ilium areas of a human body;

an overlap, the overlap being coextensive from the hour glass simulated shaped shoulder portion to the bottom of the front portion and located over the offset opening for protecting against impact over the offset opening, the overlap having the multi-section padding being a ¼ inch, the overlap being stitched into the first side and fastened across the offset opening by a fastening means located about the offset opening on both the first side and the second side, the overlap further being temporarily attached to the first side by an overlap fastening means sized and shaped for keeping the overlap clear of the offset opening while the user puts on the vest; and a plurality of adjustable securing belts, each belt being wrapped around the multi-section padding to secure the vest about the torso of an athlete's body, the plurality of adjustable securing belts being inserted through a plurality of vertical loops, the vertical loops being stitched into the vest at a plurality of locations uniformly spaced about the vest to hold the plurality of adjustable securing belts to engage the torso of the athlete wearing the vest, the plurality of adjustable securing belts being fastened by a plurality of belt fasteners, the plurality of belt fasteners being located about the offset opening so as to be covered by the overlap.

2. The multi-section one piece garment of claim 1, wherein the multi-section padding being formed from a polymeric cellular compound punctuated with a plurality of air holes to protect the torso against impact from sporting activities.

3. The multi-section one piece garment of claim 1, wherein the back portion contains a pair of cloth holders for holding a strip of cloth, the strip of cloth being removable by an opposing player, the back tapered design contains a back strap fastener therein to connect to a front strap fastener located on the front tapered design by a strap therein to engage the back portion to the front portion.

4. The multi-section one piece garment of claim 1, wherein the belt fasteners are sized and shaped by multi prong fasteners to withstand the impact from sporting activities and to be able to slide under the overlap.

5. A multi-section one piece garment for protecting against impact upon a human torso when worn by an athlete during sporting activities, the multi-section one piece garment comprising:

a vest sized and shaped to be worn on a torso of an athlete, the vest having a multi-section padding all around the vest for protectively encasing the torso of the athlete including a chest, a stomach, a lower abdomen, a pair of sides and a back, an hour glass simulated shaped shoulder portion, a front portion, a pair of side portions, a back portion, and an offset opening, the multi-section padding having a first section, a second section, and a third section, the hour glass simulated shaped shoulder portion having a pair of oversized apertures therein for the arms, each oversized aperture being sized and shaped to permit full movement of both arms leaving the hour glass shaped shoulder portion in an unrestricted condition, each oversized aperture having an edge, the edge being rounded to minimize body chafing, the front portion being sized and shaped in a front tapered design to allow unhindered movement of an athlete's legs and to provide protection to the lower abdomen, the back portion being sized and shaped in a back tapered design to allow unhindered movement of the athlete's legs and to provide protection to a lower spine, tailbone and ilium areas of a human body, the offset opening being coextensive from the shoulder portion to a bottom of the front portion dividing the front portion into a first side and a second side, the offset opening being located off set from a center axis of the vest to protect against body impact to internal organs such as a heart of the athlete;

an overlap, the overlap being coextensive from the shoulder portion to the bottom portion and located over the offset opening for protecting against impact over the offset opening, the overlap being stitched into the vest at the first side and fastened across the offset opening by a fastener means located about the offset opening on both the first side and the second side, and a plurality of adjustable securing belts, each belt being wrapped around the multi-section padding to secure the vest about the torso of an athlete's body.

6. The multi-section one piece garment of claim 5, wherein the first section being formed from a breathable material for allowing air to permeate the vest, the second section being formed from a padding material for protecting against impact against the torso, and the third section being formed from a breathable moisture absorbing material for absorbing moisture generated by the body.

7. The multi-section one piece garment of claim 6, wherein the hour glass simulated shaped shoulder portion having the multi-section padding being ½ inch to 1 inch to permit unhindered movement of both arms of the athlete wearing the vest, the hour glass simulated shaped shoulder portion further having a limited V-neck design sized and shaped to protect up to a clavicle area and over an athlete's shoulders while permitting full movement of an athlete's neck.

8. The multi-section one piece garment of claim 7, wherein the front portion and the pair of side portions each having the multi-section padding being 1 inch to 1½ inches sized and shaped to protect against impact against the torso while the athlete is engaged in sporting activities.

9. The multi-section one piece garment of claim 8, wherein the back portion having the multi-section padding being 1 inch to 1½ inches to protect against impact against the back while the athlete is engaged in sporting activities, the back portion containing a pair of cloth holders for holding a strip of cloth, the strip being removable by an opposing player, the back tapered design further contains a back strap fastener therein to connect to a front strap fastener located on the front tapered design by a strap therein to engage the back portion to the front portion.

10. The multi-section one piece garment of claim 9, wherein the plurality of adjustable securing belts being inserted through a plurality of vertical loops, the vertical loops being attached to the vest at a plurality of locations uniformly spaced about the vest to hold the plurality of adjustable securing belts to engage the torso of the athlete wearing the vest, the plurality of adjustable securing belts being fastened by a plurality of belt fasteners, the plurality of belt fasteners being located about the offset opening so as to be covered by the overlap.

11. The multi-section one piece garment of claim 10, wherein the multi-section padding being formed from a polymeric cellular compound punctuated with a plurality of air holes to protect the torso against impact from sporting activities.

12. The multi-section one piece garment of claim 11, wherein the first side having an overlap fastening means sized and shaped for keeping the overlap clear of the offset opening while a user puts on the vest.

13. The multi-section one piece garment of claim 12, wherein the fasteners are sized and shaped by multi prong fasteners to withstand the impact from sporting activities and to be able to slide under the overlap.

14. A multi-section one piece garment for protecting against impact upon a human torso when worn by an athlete during sporting activities, the multi-section one piece garment comprising:

a vest sized and shaped to be worn on a torso of an athlete, the vest having a multi-section padding all around the vest for protectively encasing the torso of the athlete including a chest, a stomach, and a lower abdomen, a pair of sides and a back, a shoulder portion, a front portion, a pair of side portions, a back portion, and an offset opening, the offset opening being coextensive from the shoulder portion to a bottom of the front portion dividing the front portion into a first side and a second side, the offset opening being located off set from a center axis of the vest to protect against body impact to internal organs such as a heart of the athlete;

an overlap, the overlap being coextensive from the shoulder portion to the bottom portion and located over the offset opening for protecting against impact over the offset opening, the overlap being attached to the vest at the first side and fastened across the offset opening by a fastener means located about the offset opening on both the first side and the second side, the first side having an overlap fastening means sized and shaped for keeping the overlap clear of the offset opening while a user puts on the vest; and a plurality of adjustable securing belts, each belt being wrapped around the multi-section padding to secure the vest about the torso of an athlete's body.

15. The multi-section one piece garment of claim 14, wherein the multi-section padding having at least three sections, a first section being formed from a breathable material for allowing air to permeate the vest, a second section being formed from a padding material for protecting against impact against the torso, a third section being formed from a breathable moisture absorbing material for absorbing moisture generated by the body.

16. The multi-section one piece garment of claim 14, wherein the shoulder portion having the multi-section padding sized and shaped to permit unhindered movement of both arms of the athlete wearing the vest, the shoulder portion further having a design sized and shaped to protect up to a clavicle area and over the top of an athlete's shoulders while permitting full movement of an athlete's neck, the shoulder portion further having a pair of oversized apertures therein for the arms, each oversized aperture being sized and shaped to permit full movement of both arms leaving the shoulder portion in an unrestricted condition, each oversized aperture having an edge, the edge being rounded to minimize body chafing.

17. The multi section one piece garment of claim 14, wherein the front portion being sized and shaped in a front tapered design to allow unhindered movement of an athlete's legs and to provide protection to the lower abdomen.

18. The multi-section one piece garment of claim 14, wherein the back portion having the multi-section padding sized and shaped to protect against impact against the back while the athlete is engaged in sporting activities, the back portion being sized and shaped in a back tapered design to allow unhindered movement of an athlete's legs and to provide protection to a lower spine, tailbone and ilium areas of a human body, the back portion containing at least one cloth holder for holding a strip of cloth, the strip being removable by an opposing player, the back tapered design contains a back strap fastener therein to connect to a front strap fastener located on the front tapered design by a strap therein to engage the back portion to the front portion.

19. The multi-section one piece garment of claim 14, wherein the plurality of adjustable securing belts being attached to the vest by a plurality of attachment means to engage the torso of the athlete wearing the vest, the plurality of adjustable securing belts being fastened by a plurality of belt fasteners, the plurality of belt fasteners being located about the offset opening so as to be covered by the overlap.

20. The multi-section one piece garment of claim 14, wherein the multi-section padding being formed from a polymeric cellular compound punctuated with a plurality of air holes to protect the torso against impact from sporting activities.

21. The multi-section one piece garment of claim 14, wherein the fasteners are sized and shaped by multi prong fasteners to withstand the impact from sporting activities and to be able to slide under the overlap.

22. A multi-section one piece garment for protecting against impact upon a human torso when worn by an athlete during sporting activities, the multi-section one piece garment comprising:

a vest sized and shaped to be worn on a torso of an athlete, the vest having a multi-section padding all around the vest for protectively encasing the torso of the athlete including a chest, and a lower abdomen, a pair of sides and a back, an hour glass simulated shaped shoulder portion, a front portion, a pair of side portions, a back portion, and an offset opening, the multi-section padding having a first section, a second section, and a third section, the hour glass simulated shaped shoulder portion having a pair of oversized apertures therein for the arms, each oversized aperture being sized and shaped to permit full movement of both arms leaving the hour glass shaped shoulder portion in an unrestricted condition, each oversized aperture having an edge, the edge being rounded to minimize body chafing, the front portion being sized and shaped in a front tapered design to allow unhindered movement of an athlete's legs and to provide protection to the lower abdomen, the back portion being sized and shaped in a back tapered design to allow unhindered movement of the athlete's legs and to provide protection to a lower spine, tailbone and ilium areas of a human body, the offset opening being coextensive from the shoulder portion to a bottom of the front portion dividing the front portion into a first side and a second side, the offset opening being located off set from a center axis of the vest to protect against body impact to internal organs such a heart of the athlete; and a plurality of adjustable securing belts, each belt being wrapped around the multi-section padding to secure the vest about the torso of the athlete, the plurality of adjustable securing belts being inserted through a plurality of vertical loops, the vertical loops being attached to the vest at a plurality of locations uniformly spaced about the vest to hold the plurality of adjustable securing belts to engage the torso of the athlete wearing the vest, the plurality of adjustable securing belts being fastened by a plurality of belt fasteners, the plurality of belt fasteners being adjustably located over the front portion.

23. The multi-section one piece garment of claim 22, wherein the first section being formed from a breathable material for allowing air to permeate the vest, the second section being formed from a padding material for protecting against impact against the torso, the third section being formed from a breathable moisture absorbing material for absorbing moisture generated by the body.

24. The multi-section one piece garment of claim 23, wherein the hour glass simulated shaped shoulder portion having the multi-section padding sized and shaped to permit unhindered movement of both arms of the athlete wearing the vest, the hour glass simulated shaped shoulder portion further having a limited V-neck design sized and shaped to protect up to a clavicle area and over an athlete's shoulders while permitting full movement of an athlete's neck.

25. The multi-section one piece garment of claim 21, wherein the back portion having the multi-section padding sized and shaped to protect against impact from sporting activities, the back portion containing a pair of cloth holders for holding a strip of cloth, the strip being removable by an opposing player, the back portion further containing a back strap fastener therein to connect to a front strap fastener located on the front tapered design by a strap therein to engage the back portion to the front portion to achieve a more secured fit of the vest.

26. The multi-section one piece garment of claim 21, wherein the multi-section padding being formed from a polymeric cellular compound to protect the torso against impact from sporting activities.

27. The multi-section one piece garment of claim 21, wherein the fasteners are sized and shaped by multi prong fasteners to withstand the impact from sporting activities and keep the vest secure around the body.

28. A multi-section one piece garment worn by females for protecting against impact upon the female torso when worn by a female athlete during sporting activities, the multi-section one piece garment comprising:

a vest sized and shaped to be worn on a torso of a female athlete, the vest having a multi-section padding all around the vest for protectively encasing the torso of the female athlete including a chest, a stomach, a pair of sides and a back, an hour glass simulated shaped shoulder portion, a front portion, a pair of side portions, a back portion, and an offset opening, the multi-section padding having a first section, a second section, and a third section, the hour glass simulated shaped shoulder portion having a pair of oversized apertures therein for the arms, each oversized aperture being sized and shaped to permit full movement of both arms leaving the hour glass shaped shoulder portion in an unrestricted condition, each oversized aperture having an edge, the edge being rounded to minimize body chafing, the front portion being sized and shaped in a front tapered design, the front portion containing the offset opening, the offset opening being coextensive from the shoulder portion to a bottom of the front portion dividing the front portion into a first side and a second side, the offset opening being located off set from a center axis of the vest to protect against body impact to internal organs such a heart of an athlete, the front portion being sized and shaped in a convex configuration, the convex configuration allowing space for each female breast, the pair of side portions being located under the pair of oversized apertures, each side portion having a concave configuration, the concave configuration allowing space for each female hip, the back portion being sized and shaped in a back tapered design to provide protection to a lower spine, tailbone and ilium areas of a human body;

an overlap, the overlap being coextensive from the shoulder portion to the bottom portion and located over the offset opening for protecting against impact over the offset opening, the overlap being sized and shaped to incorporate the convex configuration, the overlap being stitched into the vest at the first side and fastened across the offset opening by a fastener means located about the offset opening on both the first side and the second side; and a plurality of adjustable securing belts, each belt being wrapped around the multi-section padding to secure the vest about the torso of the female athlete.

29. The multi-section one piece garment of claim 28, wherein the first section being formed from a breathable material for allowing air to permeate the vest, the second section being formed from a padding material for protecting against impact against the torso, the third section being formed from a breathable moisture absorbing material for absorbing moisture generated by the body.

30. The multi-section one piece garment of claim 28, wherein the hour glass simulated shaped shoulder portion having the multi-section padding sized and shaped to permit unhindered movement of both arms of the female athlete wearing the vest, the hour glass simulated shaped shoulder portion further having a limited V-neck design sized and shaped to protect up to a clavicle area and over an athlete's shoulders while permitting full movement of an athlete's neck.

31. The multi-section one piece garment of claim 28, wherein the front portion and the pair of side portions each having multi-section padding sized and shaped to protect against impact against the chest and pair of sides while the female athlete is engaged in sporting activities.

32. The multi-section one piece garment of claim 28, wherein the back portion having the multi-section padding sized and shaped to protect against impact the back while the female athlete is engaged in sporting activities, the back portion containing a pair of cloth holders for holding a strip of cloth, the strip being removable by an opposing player, the back tapered design contains a back strap fastener therein to connect to a front strap fastener located on the front tapered design by a strap therein to engage the back portion to the front portion.

33. The multi-section one piece garment of claim 28, wherein the plurality of adjustable securing belts being inserted through a plurality of vertical loops, the vertical loops being attached to the vest at a plurality of locations uniformly spaced about the vest to hold the plurality of adjustable securing belts to engage the torso of the female athlete wearing the vest, the plurality of adjustable securing belts being fastened by a plurality of belt fasteners, the plurality of belt fasteners being located about the offset opening so as to be covered by the overlap.

34. The multi-section one piece garment of claim 31, wherein the multi-section padding being formed from a polymeric cellular compound punctuated with a plurality of air holes to protect the torso against impact from sporting activities.

35. The multi-section one piece garment of claim 31, wherein the first side having an overlap fastening means sized and shaped for keeping the overlap clear of the offset opening while a user puts on the vest.

36. The multi-section one piece garment of claim 31, wherein the fasteners are sized and shaped by multi prong fasteners to withstand the impact from sporting activities and to be able to slide under the overlap.

* * * * *

UNITED STATES PATENT AND TRADEMARK OFFICE

CERTIFICATE OF CORRECTION

PATENT NO. : 6,138,277
DATED : October 31, 2000
INVENTOR(S) : Gillen et al.

It is certified that error appears in the above-identified patent and that said Letters Patent is hereby corrected as shown below:

Column 17, claims 25, 26 & 27,
Change "21" to -- 22 --.

Signed and Sealed this

Twentieth Day of November, 2001

*Attest:*

Nicholas P. Godici

NICHOLAS P. GODICI
*Acting Director of the United States Patent and Trademark Office*

*Attesting Officer*